US007694902B2

(12) United States Patent
Demler et al.

(10) Patent No.: US 7,694,902 B2
(45) Date of Patent: Apr. 13, 2010

(54) SELF-ALIGNING AND ACTIVELY COMPENSATING REFINER STATOR PLATE SYSTEM

(75) Inventors: Christopher L. Demler, Lebanon, OH (US); John J. Egan, III, Centerville, OH (US)

(73) Assignee: Kadant Black Clawson Inc., Mason, OH (US)

( * ) Notice: Subject to any disclaimer, the term of this patent is extended or adjusted under 35 U.S.C. 154(b) by 1029 days.

(21) Appl. No.: 10/559,739

(22) PCT Filed: Jun. 8, 2005

(86) PCT No.: PCT/US2004/018103

§ 371 (c)(1),
(2), (4) Date: Apr. 17, 2006

(87) PCT Pub. No.: WO2004/111331

PCT Pub. Date: Dec. 23, 2004

(65) Prior Publication Data

US 2006/0231649 A1 Oct. 19, 2006

Related U.S. Application Data

(60) Provisional application No. 60/477,014, filed on Jun. 9, 2003.

(51) Int. Cl.
*B02C 1/00* (2006.01)

(52) U.S. Cl. ..... 241/21; 241/261.2; 241/261.3; 241/286

(58) Field of Classification Search ..... 241/37, 241/261.2, 261.3, 286, 21
See application file for complete search history.

(56) References Cited

U.S. PATENT DOCUMENTS

| | | | |
|---|---|---|---|
| 2,666,368 | A | 1/1954 | Staege et al. |
| 2,986,434 | A | 5/1961 | Baxter, Jr. |
| 3,506,199 | A | 4/1970 | Hayward |
| 3,684,200 | A | 8/1972 | Reinhall |
| 3,827,644 | A | 8/1974 | Johansson |
| 3,847,359 | A | 11/1974 | Holmes et al. |
| 4,253,613 | A | 3/1981 | Reinhall |
| 4,269,365 | A | 5/1981 | Berggren |
| 4,275,852 | A | 6/1981 | Asplund |
| 4,283,016 | A | 8/1981 | Reinhall |
| 4,610,400 | A | 9/1986 | Sjobom |
| 4,820,980 | A | 4/1989 | Dodson-Edgars |
| 5,429,316 | A | 7/1995 | Arvidsson et al. |
| 5,445,328 | A | 8/1995 | Musselman |
| 5,707,016 | A | 1/1998 | Witsken |
| 5,813,618 | A | 9/1998 | Prew |
| 5,927,628 | A | 7/1999 | Lima et al. |

(Continued)

FOREIGN PATENT DOCUMENTS

WO WO 99/52197 10/1999

*Primary Examiner*—Bena Miller
(74) *Attorney, Agent, or Firm*—Wegman, Hessler & Vanderburg

(57) ABSTRACT

An improvement to a mechanical refining system relates to an apparatus including three or more actuators (100) coupled to a stator (42) of the refining system, and a controller for independently operating the actuators. An improved method of refining permits adjustment of the overall width of a refining gap between refining elements mounted by the stator and a rotor as well as the trim of the refining elements relative to each other.

4 Claims, 7 Drawing Sheets

U.S. PATENT DOCUMENTS 5,947,394 A 9/1999 Egan, II et al.
5,971,307 A 10/1999 Davenport
6,135,373 A 10/2000 Davenport
6,209,813 B1 4/2001 Lima et al.
6,322,013 B1 11/2001 Lima et al.
6,617,720 B1 * 9/2003 Egan et al. ..... 310/67 R
7,508,194 B2 * 3/2009 Åkerblom ..... 324/207.13
2002/0070303 A1 * 6/2002 Johansson et al. ..... 241/261.3
2003/0071153 A1 * 4/2003 Aikawa ..... 241/246
2005/0247808 A1 * 11/2005 Huhtanen et al. ..... 241/261.1

* cited by examiner

SELF-ALIGNING AND ACTIVELY COMPENSATING REFINER STATOR PLATE SYSTEM

CROSS-REFERENCE TO RELATED APPLICATION

This application claims the priority benefit of International PCT application PCT/US04/018103 filed Jun. 8, 2004, and published under PCT 21(2) in the English language; and U.S. Provisional Patent Application Ser. No. 60/477,014 filed Jun. 9, 2003.

FIELD OF THE INVENTION

This invention relates to an improved mechanical refiner. More particularly, it relates to an improvement to a mechanical refiner having a stator mounting a first refining element and a rotor mounting a second refining element spaced from said first refining element to define a refining gap. The refining gap and alignment of the trim, or angular orientation, of the refining elements relative to one another are actively maintained according to various conditions of the refining elements or the number of motor revolutions even as the refiner is in use. Actuators are coupled to the stator and a controller to adjust the average or overall width of the refining gap and the trim, or angular orientation, of the stator relative to the rotor, thus providing three or more degrees of control over the spacing between the stator and the rotor.

BACKGROUND OF THE INVENTION

Cellulosic fibers such as paper pulp, bagasse, insulation or fiber board materials, cotton and the like, are commonly subjected to a refining operation which consists of mechanically rubbing the fibers between sets of relatively rotating bar and groove elements. In a disk-type refiner, for example, these elements commonly consist of plates having annularly arranged bar and groove patterns defining their working surfaces, with the bars and grooves extending generally radially of an axis of the rotating element, or more often at an angle oblique to a radius to the center of the annular pattern, so that the stock can work its way from the center of the pattern to its outer periphery.

Disk-refiners are commonly manufactured in both single and twin disk types. In a single disk refiner, the working surface of the rotor comprises an annular refiner plate, or a set of segmental refiner plates, for cooperative working action with a complementary working surface on the stator, which also comprises an annular plate or a series of segmental plates forming an annulus. In a twin disk refiner, the rotor is provided with working surfaces on both sides. The working surfaces of the rotor cooperate with a pair of opposed complementary working surfaces on the stator, with these working surfaces being generally of the same type of construction as with a single disk refiner.

Paper pulp refiners as described, including the plug or cone type refiners, require the control of the position and axial spacing of the relatively rotating members for the purpose of controlling refiner load and for controlling the quality of the refined paper fiber product, among other reasons. A plug type refiner is shown in Staege et al., U.S. Pat. No. 2,666,368, while a control arrangement for a dual inlet disk type refiner is shown in Hayward U.S. Pat. No. 3,506,199.

Known refiners have included mechanical drive systems for moving one refining element closer or farther from the other along the axis of rotation of the rotor. It also is known to provide electrical or electronic controllers, such as that shown in Hayward, to control the axial spacing of the refining elements in response to motor load, changing voltage or power factors, or pulp quality. Reference may be had to Baxter U.S. Pat. No. 2,986,434, which shows a dual inlet radial disk type refiner and the reduction gearing through which the axial position of the stator and rotor elements may be accurately determined and maintained.

Mechanical refining is optimized when the gap between the refining elements of the stator and rotor is on the order of 0.001 inch to 0.010 inch (0.025 mm to 0.25 mm). The actual spacing of the stator and rotor plates is dependent upon numerous stack-up items in the assembly of the refiner. Due to typical manufacturing tolerances, the design misalignment can be as much as 0.045 inch (1.1 mm).

One drawback to known refining systems is that they make no provision for correcting errors in the trim, or angular orientation, of the refining elements relative to one another. Thus, when the stator plate is inclined relative to the rotor plate, for example, certain portions of the refining surface of the refining element mounted by the stator plate will be closer to the complementary surface of the refining element mounted by the rotor than other portions of the refining surface. This implies a variation in the width of the refining gap between the refining elements along the surfaces of the refining elements even when the average or overall refining gap is optimized.

Dodson-Edgars U.S. Pat. No. 4,820,980 shows an apparatus and method for measuring the gap, tram, deflection and wear of rotating grinding plates such as those found in mechanical refiners. In particular, Dodson-Edgars shows inductive sensors mounted in a recessed manner inset from the surface of a first grinding plate and located opposite recessed non-wear surfaces of a second grinding plate. The sensors are monitored by a microprocessor system, which processes signals from the sensors to determine gap, tram, deflection and wear. Dodson-Edgars teaches that plate tram may be controlled by angular displacement of the drive shaft which drives one of the rotating plates or by angular displacement of the other, stationary plate, but does not disclose any apparatus for carrying out such an adjustment.

Thus, there remains a need in the art for an improved mechanical refining system providing control, preferably automatic control, of the trim of the refining elements mounted by the stator and rotor relative to one another, as well as providing automatic control of the average or overall refining gap between the elements.

SUMMARY OF THE INVENTION

This need and others are addressed by a mechanical refiner system which permits adjustment of the overall, or average, gap between the refining elements and of the trim, or angular orientation, of the refining elements relative to one another. The preferred apparatus is a mechanical refiner system including three or more actuators, for example, coupled to the stator, and a controller in communication with those actuators for independently operating the actuators to adjust the average, or overall, axial width of the refining gap as well as to adjust the trim, or angular orientation, of the refining elements relative to one another.

The preferred apparatus of the present invention provides an improved degree of control over the separation of the refining elements of a mechanical refining system. It permits an operator to adjust the average, or overall, refining gap and to correct misalignments of the refining elements immediately after assembly and/or as the refining elements wear in the course of service. In this manner, the operator can improve the performance of the mechanical refining system throughout the useful lives of the refining elements.

In accordance with an especially preferred embodiment, the apparatus comprises an end plate; a stator including a refining element; and three or more actuators coupled to the stator for controlling the position and orientation of the stator relative to the rotor. In accordance with this embodiment, the preferred mechanical refiner includes a casing defining a refiner compartment having an open end. The end plate closes the open end of the refiner compartment and supports the actuators, which actuators adjust the spacing and relative angular orientation of the stator and the rotor. The nature of the three or more actuators is not critical to the invention, although preferred actuators include electric motors, hydraulic motors and pneumatic motors. Most preferably, the three or more actuators are electric motors and the controller is an electronic controller, or encoder, programmed to independently operate the actuators to adjust both the overall axial width of the refining gap and the relative trim, or angular orientation, of the refining elements.

In accordance with another especially preferred embodiment, at least one of the actuators has a ram extending substantially in parallel with the axis about which the rotor rotates so as to provide adjustment of the refining gap. In accordance with yet another especially preferred embodiment, at least one of the actuators has a drive shaft extending transversely to the axis. Such apparatus preferably includes a transmission connected between the actuators and the stator for converting rotary power from the actuators into axial translation of the stator relative to the rotor.

In accordance with still another preferred embodiment, the apparatus includes at least three distance sensors mounted on the stator for generating a plurality of sensor signals related to the axial width of the refiner gap at different positions on the refining surface of the stator. In accordance with this embodiment, the preferred controller, or encoder, is programmed to compare the sensor signals with one or more reference values, such as initialized values, for example. In addition, the preferred controller, or encoder, is programmed to independently operate the actuators to adjust both the overall width of the refining gap and the trim of the refining elements relative to each other. The structure is capable of providing automatic optimization of the spacing and trim, or angular orientation, of the refining elements throughout the useful lives of those elements, even when the operator of the system is unskilled.

The preferred apparatus in accordance with the invention is capable of serving either as an original component of a mechanical refining system or as a retrofit to existing equipment. To this end, configurations of the stator housing and the stator plate are not critical to the invention; rather, those skilled in the art will recognize that a wide variety of stator housing and stator plate configurations will be within the scope of the present invention depending on the specifications of the system in which the apparatus is to be used.

Another aspect of the present invention involves a method for refining a slurry using a mechanical refiner having an inlet for receiving the slurry to be refined, a discharge outlet for refined slurry, a stator mounting a first refining element defining a refining surface, and a rotor mounting a second refining element facing the refining surface to define a refining gap in communication with the inlet and the discharge outlet. A preferred method in accordance with the invention comprises the steps of comparing the local axial width of the refining gap at three or more positions along said refining surface with one or more reference values, such as initialized gap values, for example; independently moving three or more portions on the stator along the axis to adjust both the axial width of the refining gap and the trim, or angular orientation, of the first refining element relative to the second refining element; inducing the slurry to flow through the inlet into the refining gap; and turning the rotor about the axis and relative to the stator to refine the slurry in the refining gap. Most preferably, the independent movement of the three or more portions of the stator along the axis is effected by three or more actuators acting under the influence of sensor signals generated by distance sensors.

Therefore, it is one object of the present invention to provide better control over the overall refining gap and relative the trim, or angular orientation, of the refining elements. It is another object of the invention to provide such control automatically. These and other objects and advantages of the invention will be apparent from the following description, the accompanying drawing and the appended claims.

DETAILED DESCRIPTION OF THE PREFERRED EMBODIMENT

Preferred exemplary embodiments of an exemplary dual disc type refining system with actuator controlled positioning of a refining gap will be described herein with reference to FIGS. 1-6. Those of ordinary skill in the art will recognize that the various exemplary embodiments of the invention described herein can be adopted to other conventional forms of refining equipment without undue experimentation.

Figure 1:
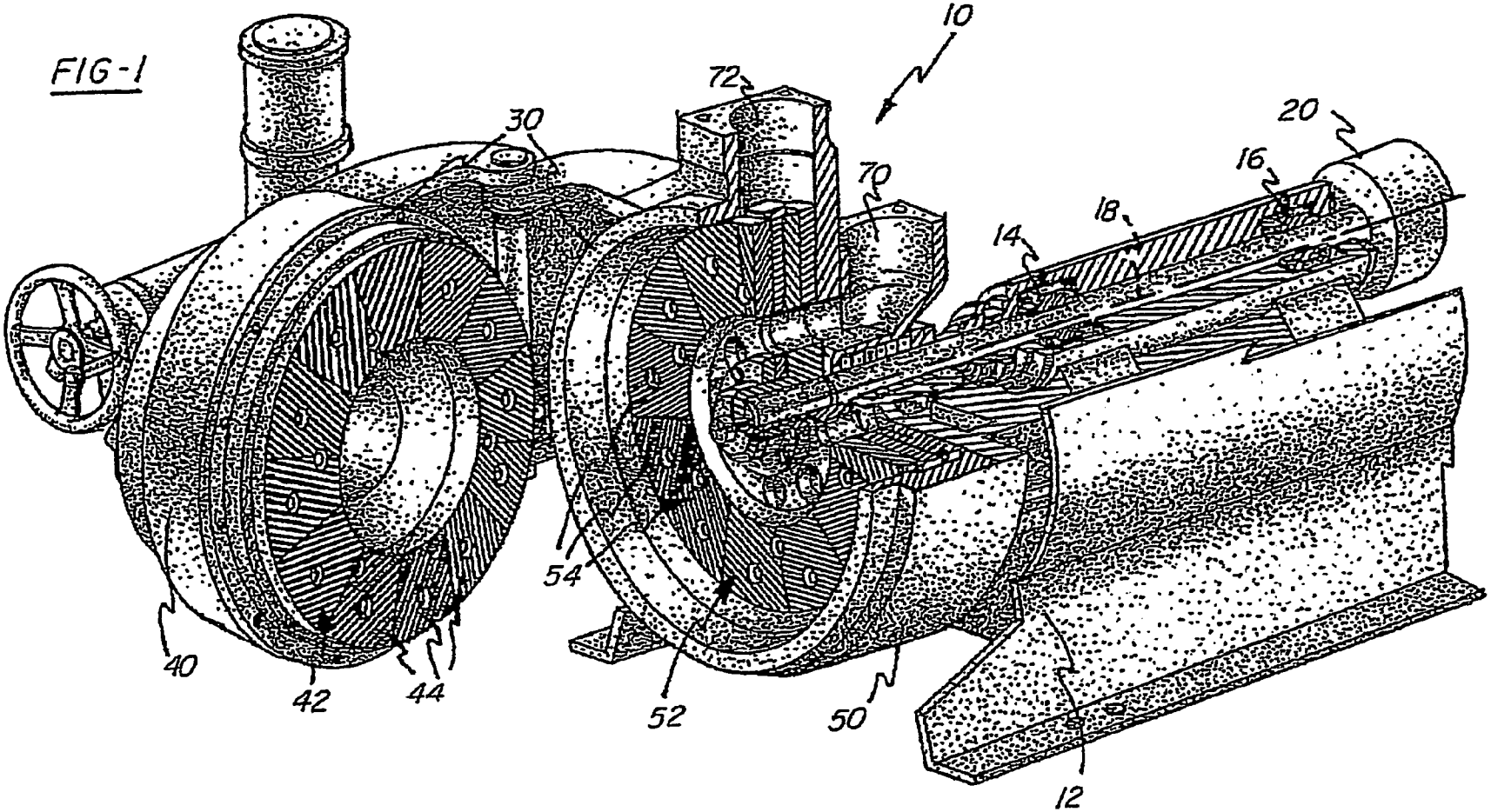
FIG. 1 is perspective view of an exemplary embodiment of a refining system in accordance with the invention.

FIG. 1 shows generally an exemplary embodiment of a dual disc refiner system 10 designed for preferred application in the refining of paper and pulp slurries according to the invention. The refiner 10 incorporates some of the principles and advantages as described in Egan et al. U.S. Pat. No. 5,947,394, issued Sep. 7, 1999; and in Egan et al. International Publication No. WO 99/52197, published Oct. 14, 1999, the disclosures of both being incorporated herein by reference. Also, familiarity with paper pulp refiners, including radially positioned disk-type refiner plates with bar and groove patterns, is assumed.

The system 10 is comprised of a mounting base 12 having bearing mounts 14, 16 supporting a drive shaft 18. The drive shaft 18 is rotatably driven by a motor 20 at one end of the drive shaft 18. The drive shaft 18 extends along a longitudinal axis a from one end, whereat the motor 20 is provided, to a second end, whereat a refining compartment 30 is provided. The refining compartment 30 is comprised of a pivotable stator door 40 housing a stator 42 fixed therein, and a rotor chamber 50 housing a rotor 52 opposite the stator door 40.

The refining compartment is thus formed by the stator door 40 and the rotor chamber 50 as the stator door 40 is in its closed position. The rotor 52 provided in the rotor chamber 50, and the stator 42 provided in the stator door 40 thus oppose one another in close proximity when the stator door 40 is closed. The distance between the stator 42 and rotor 52 in the refining compartment 30 when the stator door 40 is closed is the refining gap 60, which may vary as the refining system is used.

The drive shaft 18 extends longitudinally through a central hub of the rotor 52 and stator 42 when the stator door 40 is closed. Most preferably, seals 80 surround the drive shaft 18 at those central hub portions of the stator 42 and rotor 52 so as to cushion vibrations of the drive shaft 18 and to permit small axial and angular movements of the stator 42 or rotor 52 as appropriate during operation of the refiner system 10. Of course, those skilled in the art will recognize that the use of various forms of motors or actuators, other than those described herein, is within the scope of the invention.

The stator 42 may be comprised of several sectors 44, for example, to accommodate easier and less expensive maintenance or replacement of individual sectors 44 of the stator 42 as needed. The rotor 52 is similarly comprised of several sectors 54, for example, to also accommodate easier and less expensive maintenance or replacement of the sectors 54 of the rotor 52 as needed. Each sector 44, 54 is further comprised of refining surfaces such as bar and groove channel patterns, that complement one another to facilitate refining of slurry (not shown) within the refining gap 60 between the stator 42 and rotor 52 when the stator door 40 is closed. The bar an groove channel patterns on the stator 42 and rotor 52 may graduate from larger channels at the inner diameter at the center of the stator 42 and rotor 52, to smaller channels as the patterns extend away from the center to a perimeter of the stator 42, or rotor 52. The bar and groove channel patterns thus help to induce the flow of refined slurry to exit the refinement compartment 30.

The refining compartment 30 thus includes a slurry inlet 70 to introduce slurry to the refining gap 60 region between the stator 42 and rotor 52, and a slurry outlet 72 to discharge the refined slurry from the refining compartment 30 at a perimeter of the chamber 50. The slurry inlet 70 generally introduces slurry to a central hub portion of the rotor 52 near the second end of the drive shaft 18. The slurry inlet 70 and slurry outlet 72 may vary in size according to the flow requirements of a particular operation by inserting or removing portable fittings (not shown) to/from the slurry inlet 70 and slurry outlet 72 as desired.

Figure 2:
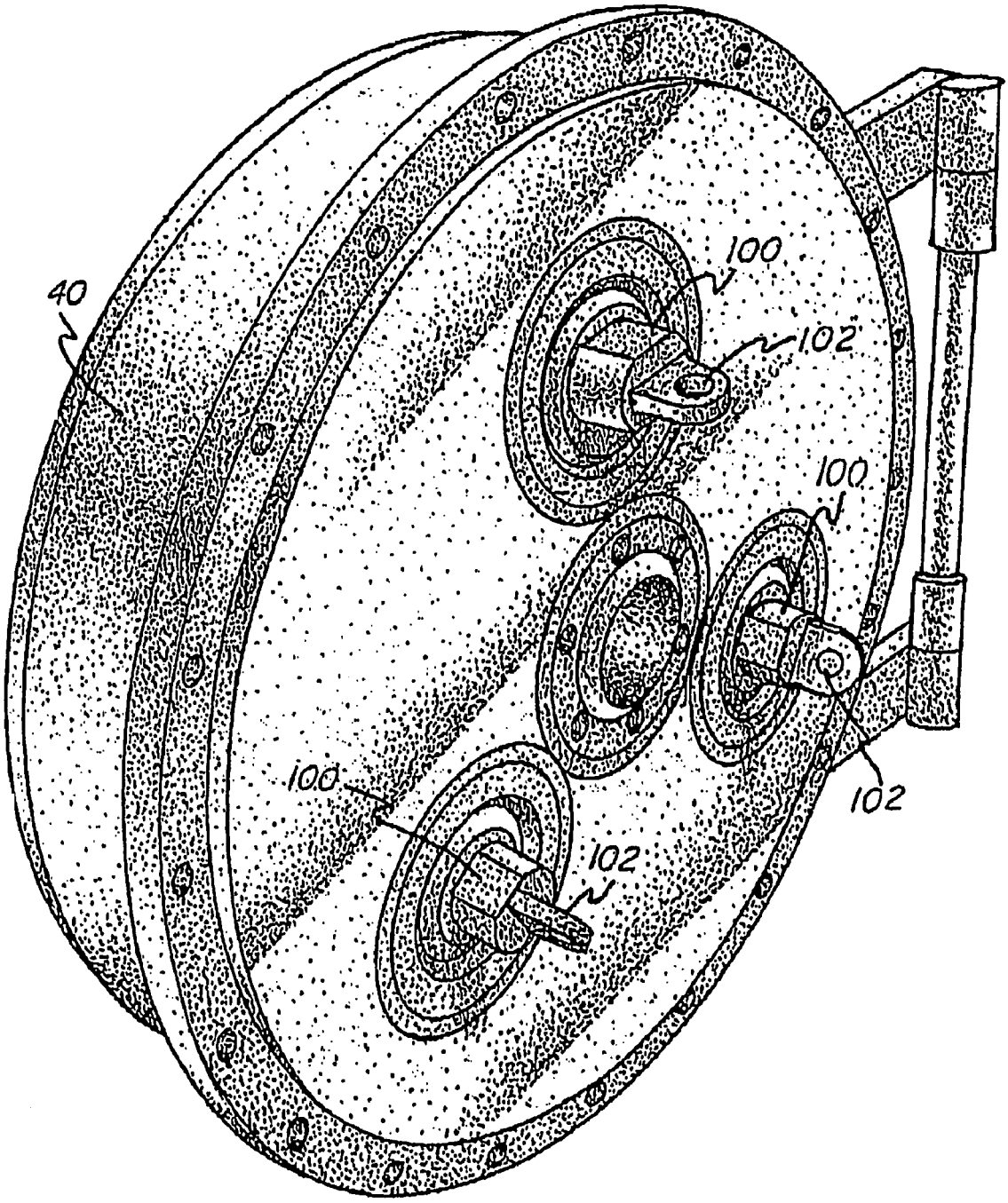
FIG. 2 is a partial side view of an exemplary stator door with actuators in the refining system of FIG. 1.

FIG. 2 illustrates one exemplary embodiment of the stator door 40 according to the refiner system described in FIG. 1. The exemplary stator door 40 of FIG. 2 includes three or more actuators 100 detachably mounted to the stator door 40, wherein the movable, or actuatable, portion of each actuator 100 is recessed into the cavity of the stator door 40. Projecting from the exposed portion of each actuator 100 is a threaded eye 102.

Figure 3:
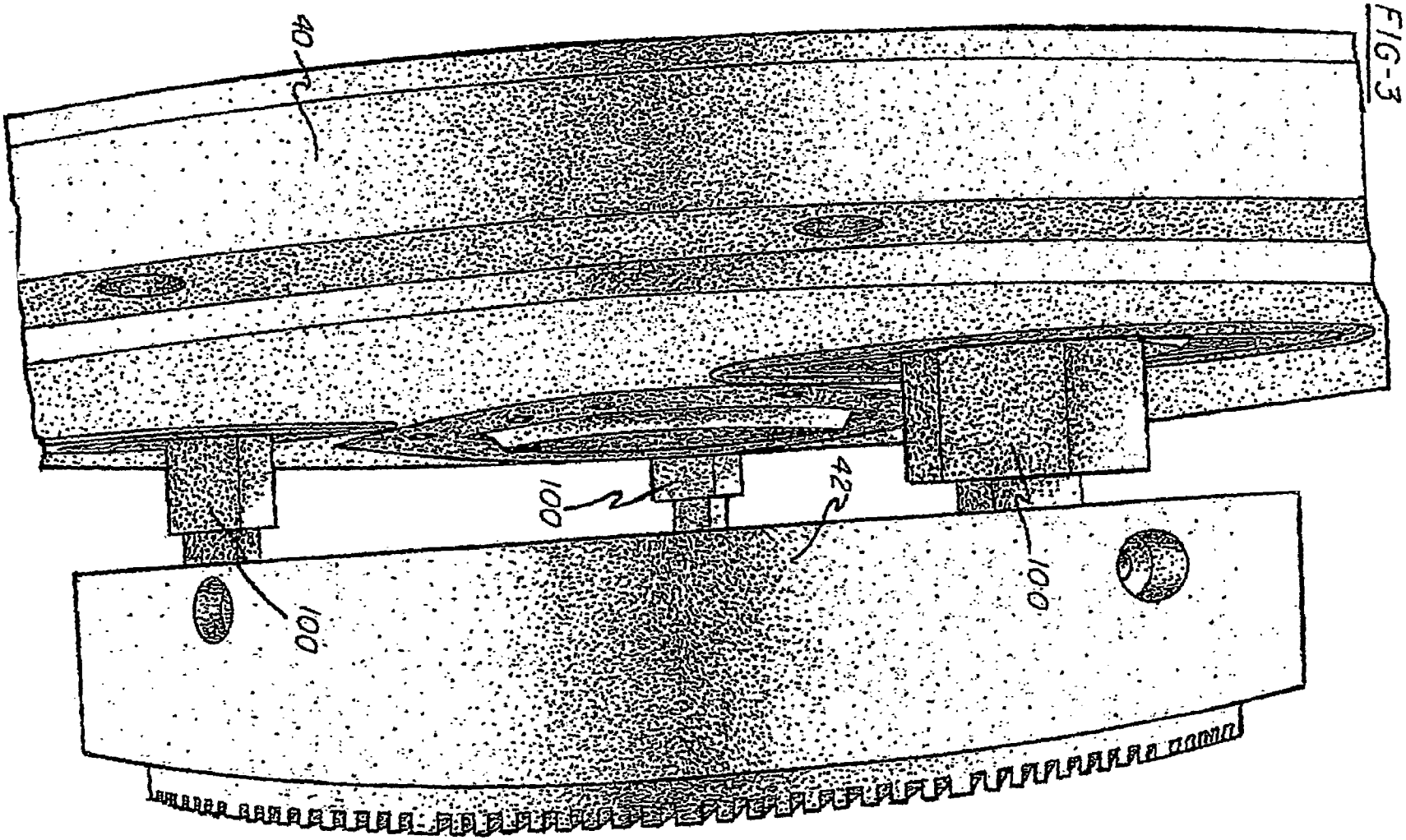
FIG. 3 is a side view of the stator mounted to the stator door of FIG. 2.
Figure 4:
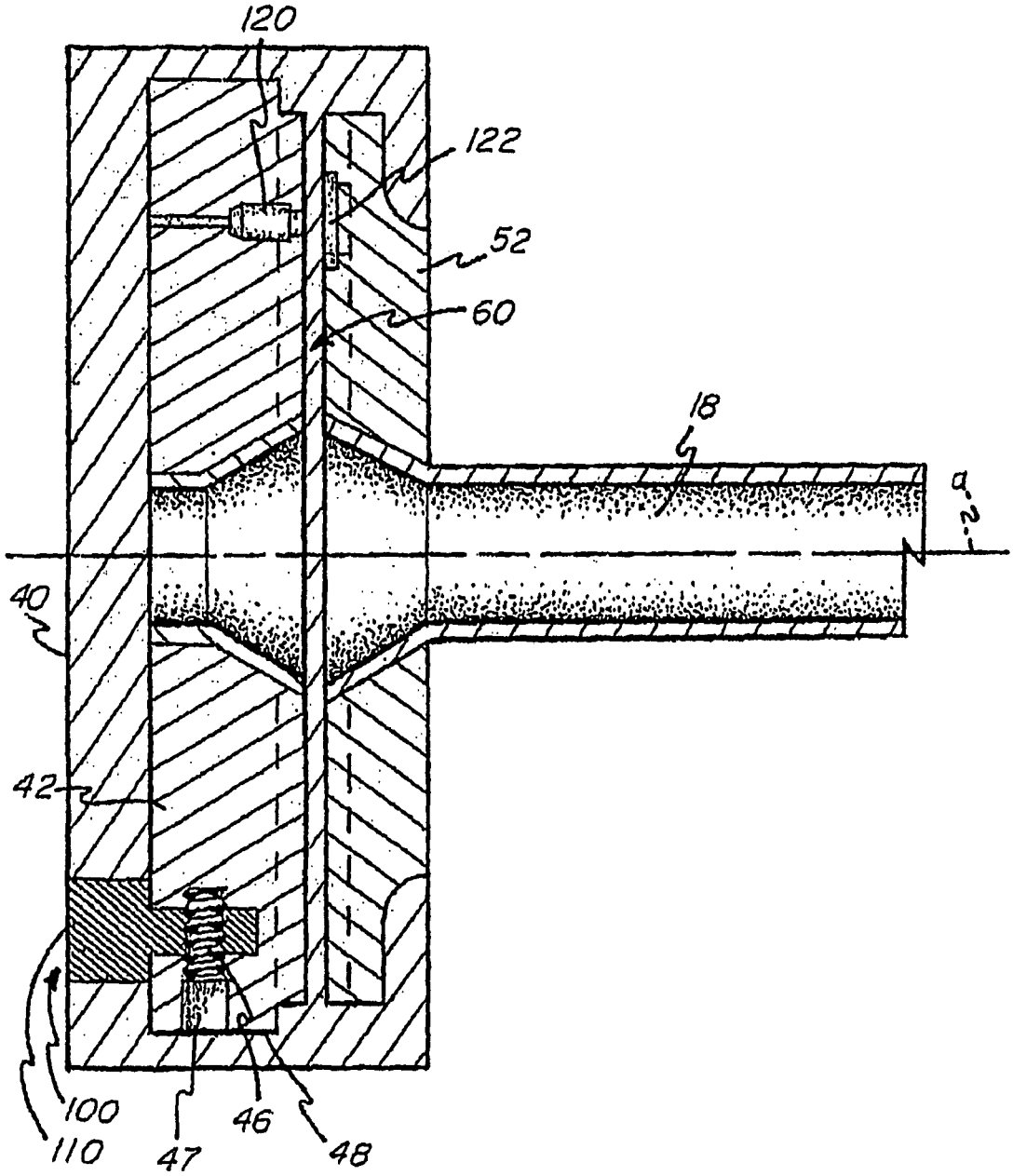
FIG. 4 is an alternative embodiment of the actuators of the refining system of FIG. 3.

FIG. 3 illustrates the stator 42 mounted to the threaded eye 102 of each actuator 100 of the exemplary stator door 40 shown in FIG. 2. As shown in FIG. 3 and FIG. 4, the stator 42 is thus attached to each actuator 100 by screws 46 driven through a threaded bore 47 on an outer band 48 of the stator 42. Thus, the stator 42 is attached to the threaded eye 102 at one end of each actuator 100, and another end of each actuator 100 is attached to a corresponding recess in the stator door 40. Attachment of the stator 42 to the actuators 100 in this manner permits the actuators 100 to move the stator 42 in three degrees of motion independently of one another and in response to changing refining gap 60 distance conditions, or to varying pressure or temperature conditions between various the sectors 44, 54 of the stator 42 and rotor 52, respectively.

FIG. 4 illustrates an alternative embodiment of the exemplary preferred actuators 100 of FIG. 3. As shown in FIG. 4, the actuators 100 each include rams 110 (only one shown in FIG. 2) of the actuator 100 coupled to the stator 42 and stator door 40. In the embodiment shown in FIG. 4, each of the actuators 100 are attached to the stator via the threaded eye 102 through which screw 46 is inserted, whereas the rams 110 of each actuator are attached to the stator door 40 using demountable fasteners to facilitate the removal, replacement or servicing of each actuator 100. Those skilled in the art will recognize that the manner in which the actuators 100 are coupled to the stator is not critical to the present invention. It is within the contemplation of the invention to use pivotable or universal couplings to mount the actuators 100 to the stator door 40 and stator 42 in order to permit the stator 42 to pivot about axes (not shown) transverse to the axis a as the actuators 100 are operated independently of one another.

As also shown in FIG. 4, and in accordance with one exemplary embodiment, the stator 42 also mounts three or more distance sensors 120 (only one shown in FIG. 4) for measuring the local axial width of the refining gap 60. The rotor 52 preferably mounts a plurality of sensible elements or recesses 122 to provide targets to assist the distance sensors 120 in measuring the local width of the gap 60. Most preferably, the distance sensors 120 are electrical sensors symmetrically arranged with respect to the axis a so as to provide information regarding both the overall width of the refining gap 60, and the trim, or angular orientation, of the refining elements, i.e., stator 42 and rotor 52, relative to one another. Examples of such sensors are described in Dodson-Edgars U.S. Pat. No. 4,820,980, the disclosure of which is incorporated by reference.

One reasonably skilled in the art would appreciate that the type of distance sensors 120 used is not critical to the present invention. Potentially useful sensor types include electrical or magnetic induction sensors and ultrasonic sensors (in conjunction with sensible elements 122 composed of material having suitable electromagnetic or acoustic properties). Other suitable types of sensors will be apparent to those of ordinary skill in the art without departing from the scope of the present invention.

Figure 5:
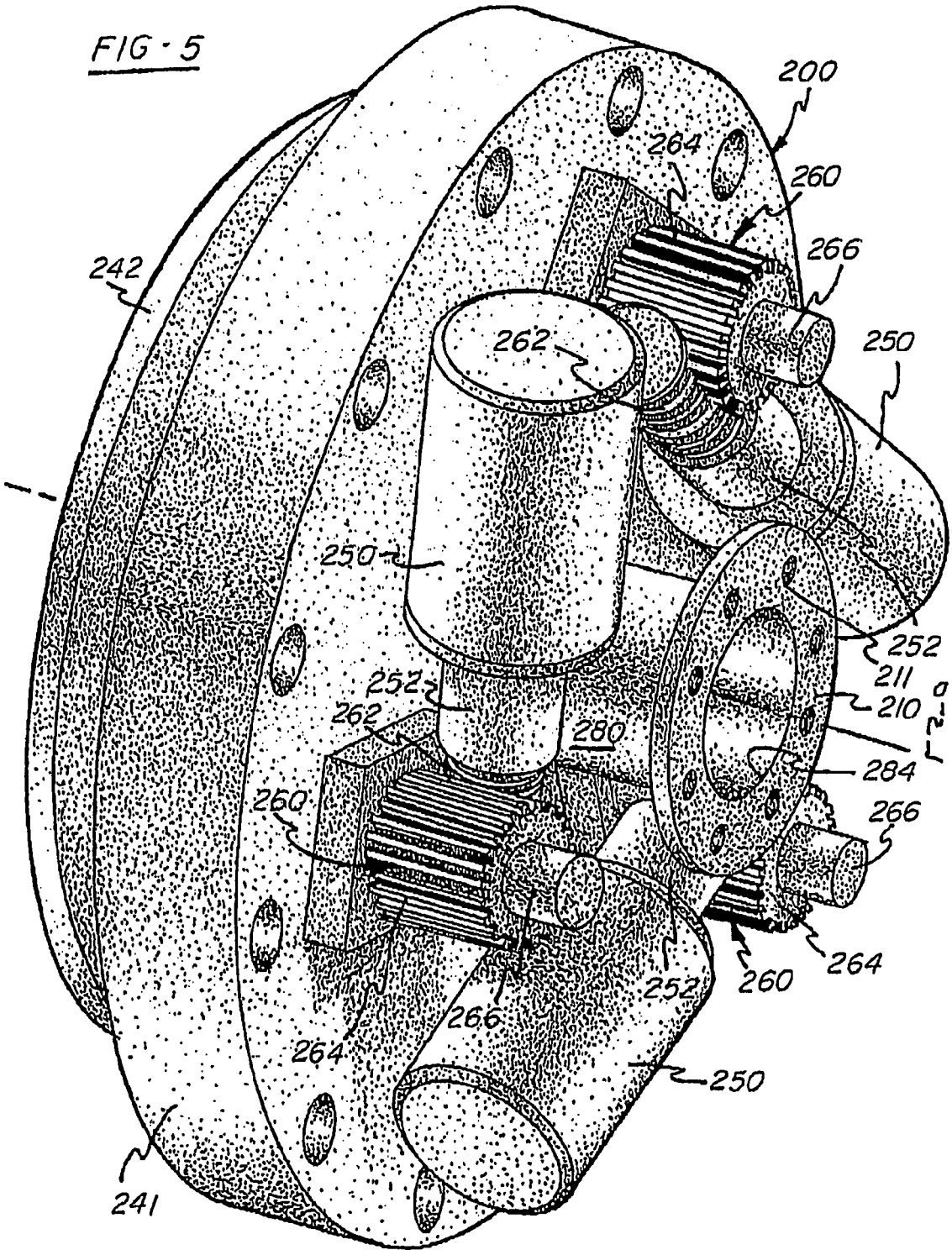
FIG. 5 is a side view of an alternative exemplary embodiment of the stator with actuators for use with a refining system in accordance with the invention.

FIG. 5 shows yet another alternative form of a stator assembly 200 in accordance with the present invention. The stator assembly 200 includes an end plate 241 mountable to the stator door (not shown in FIG. 5) and a stator plate 242 supported by the end plate 241. The end plate 241 is mountable to the stator door via a central hub portion 210 having bolt holes 211 through which bolts may be inserted to secure the stator end plate 241 to the stator door. The stator end plate 241, in addition, mounts three or more actuators 250. Each of the actuators 250 preferably is an electric motor including a drive shaft 251 for transmitting rotary or pivotal motion. In addition, the stator assembly 200 includes a plurality of transmissions 260 associated with the actuators 250.

The preferred transmissions 260 each include gears 262 mounted on the drive shafts of the actuators 250; mating gears 2644 mounted on the stator end plate 241 so as to convert rotary or pivotal motion about axes (not shown) transverse to the axis a into rotary or pivotal motion about axes (not shown) parallel to the axis a; and rams 266 in meshing or threaded engagement with the mating gears 264 to convert rotary or pivotal motion about the axes (not shown) parallel to the axis a into translation parallel to the axis a. The rams 266 preferably are coupled to the stator plate 242 in the same manner in which the rams 110 (FIG. 4) were coupled to the stator plate 42 (FIG. 4) of the earlier embodiment, although the manner of such coupling is not critical to the present invention. The preferred actuators 250 preferably communicate with a controller (not shown) to permit independent operation of the actuators 250 to adjust the position and trim of the stator plate 242.

The stator assembly 200 of FIG. 5 further includes an inlet pipe 280 which defines an inlet passage 284 which extends through the stator plate 242. The inlet passage 284 provides a path for introducing stock suspension or slurry (not shown) into a refining gap (not shown) between the stator plate 242 and a rotor plate (not shown) to permit refining of the stock suspension slurry (not shown) in the manner described earlier.

Figure 6:
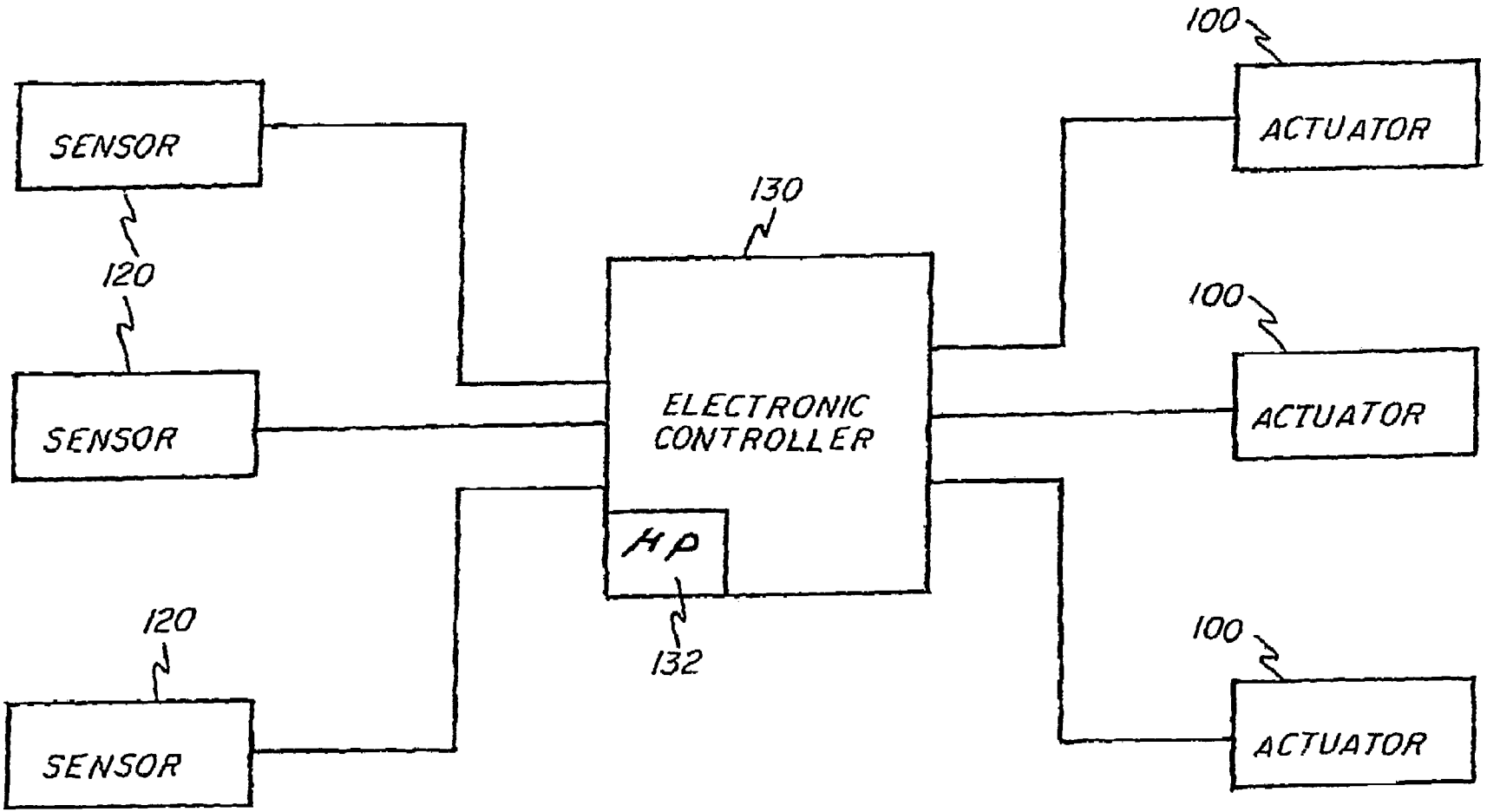
FIG. 6 is a schematic diagram of the relationship between sensors and actuators controlling the refining gap according to the invention.

With reference to FIG. 6, the three or more distance sensors 120 (only three shown in FIG. 6) communicate with a controller 130. The preferred controller 130 is an electrical or electronic controller, or encoder, including a microprocessor 132 programmed to automatically operating the actuators 100 in response to signals received from the sensors 120. The programming of the microprocessor 132 to perform this function is within the ordinary skill in the art and would require no undue experimentation to implement.

In accordance with an exemplary mode of operation, and with reference to FIG. 4, the distance sensors 120 generate signals related to the local axial width of the refining gap 60 at different positions along the refining surface of the stator 42 and rotor 52. The microprocessor 132 averages these local axial widths to determine the overall width of the refining gap 60 and compares these local axial widths with one another to determine the trim, or angular orientation, of the stator 42 relative to the rotor 52. This information is either communicated to an operator (not shown) by the preferred controller 130 (FIG. 6) or used within the controller 130 (FIG. 3) to operate the actuators 100 in response to the signals.

More preferably, the electronic controller 130 (FIG. 6) independently energizes the actuators 100 to adjust the overall width of the refining gap 60 as well as the trim, or angular orientation, of the stator 42 relative to the rotor 52. More specifically, the microprocessor 132 (FIG. 3) digitizes the signals (not shown) received from the sensors 120, averages the digitized values of those signals and compares the average with a reference value to determine the degree to which the overall width of the refining gap 60 differs from a desired width or range of width. The preferred microprocessor 132 (FIG. 6) also compares the digitized values of the signals received from the sensors 120 with reference values to determine the degree to which the stator 42 is out of trim with rotor 52.

Coordinated energization of the actuators 100 tends to correct errors in the overall width of the refining gap 60. Energizing one of the actuators 100 independently of the others causes one portion of the stator 42 to move axially relative to other portions of the stator 42. Since the preferred stator 42 is rigid, this causes the stator 42 to pivot about an axis (not shown) transverse to the axis a, thereby correcting misalignment between the stator 42 and rotor 52. In this manner, the preferred apparatus permits automatic adjustment of the overall refining gap 60 and of the trim, or angular orientation, of the stator 42 and rotor 52.

Alternatively, it is within the scope of the invention to provide the controller 130 (FIG. 3) with switches (not shown) to permit manual adjustment of the overall width of the refining gap 60 and of the trim of the stator 42 relative to the rotor 52. Such manual adjustment may be performed either in response to visual observations of an operator (not shown) or in response to a readout (not shown) of information derived from signals generated by the distance sensors 130.

Figure 7:
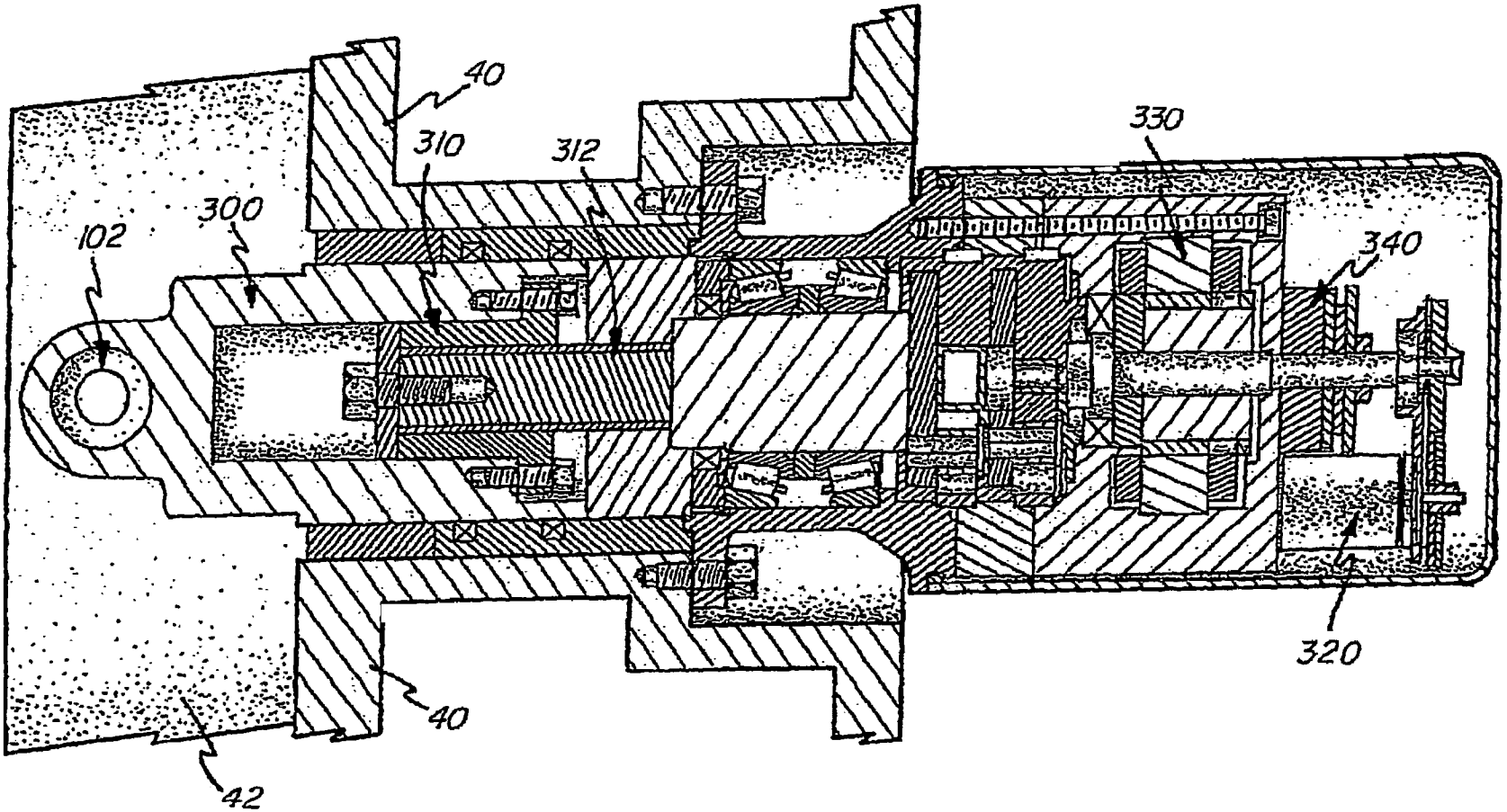
FIG. 7 is a schematic view of a second exemplary embodiment of the refining system in accordance with the invention.

FIG. 7 shows another alternative embodiment of the invention, wherein actuators 300 are similarly mounted to the stator 42 as in FIGS. 2-4, but are responsive to rotary encoders 320, or other similar technology, rather than distance sensors 120 as in FIG. 4. The actuators 300 in this exemplary embodiment are comprised of a preloaded ball nut 310 adjacent precision threads 312. The encoder 320 counts the revolutions of motor 330, that drives the preloaded ball nut 310 accordingly. A brake 340 is available when the encoder 320 determines that the motor 330 has driven the ball nut 310 to a desired position via precision threads 312.

Thus, in all of the exemplary embodiments described with reference to FIGS. 1-7, the refining gap 60 is initialized to a desired gap value prior to the occurrence of a first refining process. Thereafter, as the refining process occurs, the rotary encoder 320 (FIG. 7) tracks the forward and backward revolutions of the motor, or the sensors 120 (FIGS. 1-6) compares current pressure, temperature or distance conditions between the stator and rotor to determine the refining gap change relative to the initialized gap value. If necessary, the refining gap 60 may be re-initialized manually or automatically, as desired, should the change in the refining gap be beyond acceptable limits. Numerous refining processes may occur before re-initialization is needed. Such re-initialization can therefore occur in response to predictable wear on the refining elements due to the number of revolutions of the motor, for example, or due to other pressure and/or temperature conditions experienced during the refining processes. Thus, by actively engaging in a strategic re-initialization schedule based on initialized gap values and ongoing processing conditions, plate wear and system errors can be compensated for, and better refining element alignment can be achieved. Of course, it should be appreciated that similar advantages are possible to be achieved using the sensor 100 and actuators herein described to adjust the refining gap 60 as well.

The preferred embodiments of the present invention can be used either as original equipment components in newly-manufactured refining systems or as retrofits to existing systems. One advantage of the present invention is that it permits adjustment of both the overall width of the refining gap 60 as well as adjustment of the trim, or angular orientation, of the stator 42 relative to the rotor 52. In this manner, it allows operators to correct misalignments occurring during assembly of the refiner system 10, and to correct misalignments resulting from operation of the refiner system 10, such as those which might result from uneven wear of the sectors 44, 54 of the stator 42 or rotor 52. Optimizing the local axial width of the refining gap 60 along the entire refining surfaces of the stator 42 and rotor 52, and not merely the overall width of the refining gap 60, will tend to improve the efficiency of the refining system 10 and to increase the useful lives of the stator 42 and rotor 52.

Another advantage of the present invention is that it provides such adjustments automatically. It is within the contemplation of the invention to provide such adjustments while the refining system 10 is filled with fluid or even as the system 10 is operating.

While the method and form of apparatus herein described constitutes a preferred embodiment of this invention, it is to be understood that the invention is not limited to this precise method and form of apparatus, and that changes may be made therein without departing from the scope of the invention which is defined in the appended claims.

What is claimed is:

1. A method for refining a slurry using a mechanical refiner having an inlet for receiving a slurry to be refined, a discharge outlet for refined slurry, a stator mounting a first refining element, and a rotor mounting a second refining element spaced from said first refining element to define a refining gap in communication with said inlet and said discharge outlet, said rotor being supported for rotary movement about an axis and relative to said stator for refining said slurry in said refining gap; said method comprising the steps of:

a) comparing local axial widths of the refining gap at three or more positions along the first refining element with one or more reference values;

b) independently moving three or more spaced portions of the stator along the axis to adjust an axial width of the refining gap and to adjust a trim of the first refining element relative to the second refining element;

c) inducing the slurry to flow through the inlet into the refining gap; and d) rotating the rotor about the axis and relative to the stator to refine the slurry in the refining gap.

2. A method for refining a slurry using a mechanical refiner having an inlet for receiving a slurry to be refined, a discharge outlet for refined slurry, a stator mounting a first refining element, and a rotor mounting a second refining element spaced from said first refining element to define a refining gap in communication with said inlet and said discharge outlet, said rotor being supported for rotary movement about an axis and relative to said stator for refining said slurry in said refining gap; said method comprising the steps of:

a) initializing the refining gap to zero;

b) comparing operating conditions in the mechanical refiner with one or more reference values;

c) independently moving three or more spaced portions of the stator along the axis to adjust an axial width of the refining gap and to adjust a trim of the first refining element relative to the second refining element according to operating conditions;

d) inducing the slurry to flow through the inlet into the refining gap; and e) rotating the rotor about the axis and relative to the stator to refine the slurry in the refining gap.

3. The method recited in claim 2, wherein the operating conditions are at least one of refiner element wear, pressure, temperature, and motor revolutions.

4. The method recited in claim 2, wherein actuators comprising a ball nut engageable with precision threads move the spaced portions of the stator in response to an encoder information driven motor.

* * * * *